US007074549B2

(12) United States Patent
Simpson et al.

(10) Patent No.: US 7,074,549 B2
(45) **Date of Patent: *Jul. 11, 2006**

(54) PHOTOTHERMOGRAPHIC MATERIALS CONTAINING PHOSPHORS AND METHODS OF USING SAME

(75) Inventors: Sharon Mary Simpson, Lake Elmo, MN (US); Kurt DeLance Sieber, Rochester, NY (US); Andrea Lynnae Hansen, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 10 days.

This patent is subject to a terminal disclaimer.

(21) Appl. No.: 10/826,500

(22) Filed: Apr. 16, 2004

(65) Prior Publication Data

US 2005/0233269 A1 Oct. 20, 2005

(51) Int. Cl.
*G03C 5/16* (2006.01)
*G03C 1/498* (2006.01)

(52) U.S. Cl. ..... 430/350; 139/264; 139/510; 139/531; 139/603; 139/604; 139/605; 139/966; 430/967

(58) Field of Classification Search ..... 430/139, 430/619, 569, 966, 967, 604, 531, 264, 603, 430/605, 510, 350
See application file for complete search history.

(56) References Cited

U.S. PATENT DOCUMENTS

| | | | | |
|---|---|---|---|---|
| 3,431,215 | A * | 3/1969 | Chenot | 252/301.4 R |
| 4,865,944 | A | 9/1989 | Roberts et al. | |
| 6,440,649 | B1 | 8/2002 | Simpson et al. | |
| 6,573,033 | B1 | 6/2003 | Simpson et al. | |

FOREIGN PATENT DOCUMENTS

| | | |
|---|---|---|
| JP | 62-215942 | 9/1987 |
| JP | 01-22027 | 1/2001 |
| JP | 01-109101 | 4/2001 |

OTHER PUBLICATIONS

Weber, "Cerium-Activated Crystal And Glass Scintillators", 1993, pp. 99-124.
Gilliland et al., "ElectroChemical Technology" vol. 4(7/8): pp. 378-383, 1966.

* cited by examiner

*Primary Examiner*—Thorl Chea
(74) *Attorney, Agent, or Firm*—James L. Tucker; Louis M. Leichter

(57) ABSTRACT

Photothermographic materials contain an X-radiation-sensitive phosphor that emits in the range of from about 100 to about 410 nm. The X-radiation-sensitive phosphor is a rare earth phosphate, a yttrium phosphate, a strontium phosphate or a strontium fluoroborate. These photothermographic materials can be provides out of organic solvent or aqueous solvent coating formulations.

25 Claims, No Drawings

PHOTOTHERMOGRAPHIC MATERIALS CONTAINING PHOSPHORS AND METHODS OF USING SAME

FIELD OF THE INVENTION

This invention relates to X-radiation sensitive thermally-developable imaging materials. In particular, this invention relates to X-radiation sensitive photothermographic materials containing specific classes of X-radiation responsive phosphors that provide increased sensitivity (photographic speed). This invention also relates to methods of imaging using these photothermographic materials.

BACKGROUND OF THE INVENTION

Silver-containing photothermographic imaging materials (that is, photosensitive thermally developable imaging materials) that are imaged with actinic radiation and then developed using heat and without liquid processing have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), J. Sturge, V. Walworth, and A. Shepp, Eds., Van Nostrand-Reinhold, New York, 1989, Chapter 9, pp. 279–291, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

Historically, photographic films containing various silver halides have been used for various radiographic purposes. Desired sensitivity to imaging X-radiation has been achieved through amplification of a relatively small number of latent image centers without too much "noise" being added to the image. However, such films require the use of undesirable aqueous processing solutions and equipment.

The term "noise" is understood in radiography to refer to the random variations in optical density throughout a radiographic image that impair the user's ability to distinguish objects within the image. Radiographic noise is considered to have a number of components identified in the art as described for example by Ter-Pogossian, *The Physical Aspects of Diagnostic Radiology*, Harper & Row, New York, Chapter 7, 1967.

Wet-processed radiographic films have generally been used in combination with metal plates or metal oxides that convert X-radiation to electrons, or inorganic phosphors that convert X-radiation to visible radiation. Such "converting" materials are also usually provided in a separate element in what is known as "metal screens", "intensifying screens" or "phosphor panels" because if phosphors or metal oxides are included within the typical silver halide emulsion, very high image noise levels result. Thus, metal or phosphor intensifying screens or panels have been commonly used in combination with radiographic films in what are known as cassettes or radiographic imaging assemblies.

Thus, attempts to incorporate phosphors in wet silver halide to improve sensitivity to X-radiation have not been favored. K. Becker and coworkers found that incorporation of p-terphenyl into a wet silver halide emulsion gave a material with a flat energy response between 10 keV and 1000 keV but with an excessive amount of noise (K. Becker, E. Klein, and E. Zeitler, *Naturwissenschaften,* 1960, 47, 199, K. Becker, *Roentgenstr,* 1961 a, 95, 694, and K. Becker, *Roentgenstr,* 1961b, 95, 939).

U.S. Pat. No. 4,865,944 (Roberts et al.) describes "unitary" intensifying screen and radiographic elements in which layers of silver halide emulsion and phosphor-containing layers are coated adjacent to each other in conventional "wet" processed photographic materials.

Efforts have been made to increase photographic speed in photothermographic materials because such materials offer a number of important advantages over the use of conventional wet-processed photographic materials. However, a significant problem with photothermographic materials is the difficulty in achieving high speed without accompanying increases in unwanted density (Dmin) or a loss in image contrast.

Another problem arises in such materials because the level of silver halide is relatively low compared to wet-processed photographic materials. Thus, direct exposure of such materials to X-radiation would require that an undesirably high dosage be delivered to the film (through a patient) in order to produce a useful image.

One approach to reducing the amount of X-radiation exposure needed to produce an image in photothermographic materials is to place "double faced coatings" of photothermographic materials into contact with metal or phosphor intensifying screens [see for example JP Kokai 2001-109101 (Konica)]. Lamination of the phosphor screen to the photothermographic coating is described in JP Kokai 2001-022027 (Konica). The use of such contact screens can be disadvantageous. For example, in the practice of intraoral dental radiography, reuse of the expensive intensifying screens would require sterilization between uses. In addition, light spread and modulation transfer function (MTF) reducing characteristics associated with intensifying screens can reduce image sharpness to unacceptable levels.

Thus, as indicated in the previous discussion, there is a need for a way to render photothermographic materials X-radiation sensitive without a loss in photospeed or Dmax or a significant increase in fog (Dmin). There is also a need to achieve this X-radiation sensitivity in photothermographic materials without the use of heavy, bulky, and costly phosphor intensifying screens.

Advances in the art are provided with the X-radiation sensitive photothermographic materials described in U.S. Pat. No. 6,440,649 (Simpson et al.) and U.S. Pat. No. 6,573,033 (Simpson et al.).

There is a continuing need to find phosphors that can be used in either type of photothermographic material to provide increased imaging sensitivity without the accompanying problems associated with earlier photographic or photothermographic constructions.

SUMMARY OF THE INVENTION

The present invention provides a photothermographic material comprising a support having thereon, one or more imaging layers comprising:

a. a photosensitive silver halide, b. in reactive association with the photosensitive silver halide, a non-photosensitive source of reducible silver ions, c. a reducing agent for the reducible silver ions, and d. one or more X-radiation-sensitive phosphors each of which emits in the range of from about 100 to about 410 nm, the X-radiation-sensitive phosphor comprising a rare earth phosphate, or a yttrium phosphate, or a strontium phosphate, or a strontium fluoroborate.

Preferred embodiments of the present invention include an X-radiation sensitive photothermographic material that comprises a support having on one side thereof, a photothermographic imaging layer having a dry coating weight of from about 300 to about 400 g/m$^2$, the imaging layer comprising a binder and in reactive association:

a. a photosensitive silver bromide or silver bromoiodide, or mixture thereof, that has been chemically sensitized with a sulfur-containing chemical sensitizing compound, a selenium-containing chemical sensitizing compound, a tellurium-containing chemical sensitizing compound, or a gold (III)-containing chemical sensitizing compound, or mixtures of any of these chemical sensitizing agents, b. in reactive association with the photosensitive silver halide, a non-photosensitive source of reducible silver ions comprising silver behenate, silver benzotriazole, or a mixture thereof, c. a reducing agent for the reducible silver ions that comprises a hindered phenol or an ascorbic acid reducing agent, and d. one or more X-radiation-sensitive phosphors, each of which emits in the range of from about 100 to about 410 nm, the one or more X-radiation-sensitive phosphors being present in a total amount of from about 0.5 to about 20 mole per mole of total silver, the amount of total silver being from about 1 to about 5 g/m$^2$, and the X-radiation-sensitive phosphor having a monazite crystal structure and a composition that is defined by the following Structure (IV):

$$M^1{}_{a2}M^2{}_{b2}M^4{}_{d2}P_{e2}O_f \quad \text{(IV)}$$

wherein $M^1$ is lanthanum, $M^2$ is cerium, $M^4$ is strontium or a strontium-containing mixture of alkaline earth metals, $0.5<a2\leqq 1$, $0.005<b2\leqq 0.3$, $0<d2\leqq 0.1$, $0<a2+b2+d2\leqq(e2+1)$, and $(3.5e2)<f\leqq(4.5e2)$.

This invention also provides a method for forming a visible image comprising:

(A) imagewise exposing any of the photothermographic materials of the present invention to X-radiation to form a latent image, and (B) simultaneously or sequentially, heating the exposed photothermographic material to develop the latent image into a visible image.

This imaging forming method is particularly useful for a dental diagnosis of a human or animal subject.

We have unexpectedly found that the addition of specific classes of phosphors to the imaging layers (or adjacent layers) of photothermographic materials provides an increase in sensitivity to X-radiation. Moreover, we have also found that placing phosphors in reactive association with the photosensitive silver halide provides high resolution, image sharpness, and a low level of "noise" and image fog. A relatively small amount of phosphor is needed to provide these benefits.

We have also found when photothermographic films incorporating phosphors within the imaging layers (or adjacent layers) are used in association or contact with X-ray intensifying screens (such as in an imaging assembly), a further increase in sensitivity to X-radiation can occur.

The present invention further provides an X-radiation sensitive photothermographic material comprising a support having on both sides thereof, one or more of the same or different imaging layers containing a phosphor as described herein.

The inherent sensitivity of photothermographic materials to X-rays is minimal because of their low silver halide content. The development of X-radiation sensitive photothermographic materials of the present invention was achieved by the incorporation of phosphors that were thought to be useful only as "lamp" phosphors, that is phosphors used in illuminating fixtures. We found, however, that phosphors such as $LaPO_4$:Ce (P-1), $YPO_4$:Ce (P-2), $SrB_4O_7$:Eu,F (P-3), $BaMgAl_{11}O_{19}$:Ce (P-4), and $Sr_2P_2O_7$:Eu (P-5) are useful in preparing both organic and aqueous-based X-ray sensitive photothermographic materials. The phosphors of particular interest are $LaPO_4$:Ce (P-1) and $YPO_4$:Ce (P-2) as these represent low cost phosphors.

DETAILED DESCRIPTION OF THE INVENTION

The photothermographic materials of this invention can be used in black-and-white or color photothermography and in electronically generated black-and-white or color hard-copy recording. They can be used in microfilm applications, in radiographic imaging (for example digital medical imaging), X-ray radiography, and in industrial radiography.

The photothermographic materials are particularly useful for medical imaging of human or animal subjects in response to visible or X-radiation for use in diagnosis. Such applications include, but are not limited to, thoracic imaging, mammography, dental imaging, orthopedic imaging, general medical radiography, therapeutic radiography, veterinary radiography, and auto-radiography. When used with X-radiation, the photothermographic materials of this invention may be used in combination with one or more phosphor intensifying screens. Such materials are particularly useful for dental radiography when they are directly imaged by X-radiation.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation greater than 100 nm (such as sensitivity to from about 100 to about 410 nm). Thus, they are sensitive to X-radiation directly through the use of phosphors in one or more imaging layers.

The photothermographic materials are also useful for non-medical uses of visible or X-radiation (such as X-ray lithography and industrial radiography). In some imaging applications, it is often desirable that the photothermographic materials be "double-sided."

In the photothermographic materials of this invention, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer. Various non-imaging layers are usually disposed on the "backside" (non-emulsion or non-imaging side) of the materials, including conductive layers, antihalation layers, protective layers, and transport enabling layers.

Various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

For some applications it may be useful that the photothermographic materials be "double-sided" or "duplitized" and have the same or different photothermographic coatings (or imaging layers) on both sides of the support. In such constructions each side can also include one or more protective topcoat layers, primer layers, interlayers, antistatic layers, acutance layers, auxiliary layers, anti-crossover layers, and other layers readily apparent to one skilled in the art.

When the photothermographic materials are heat-developed as described below in a substantially water-free condition after, or simultaneously with, imagewise exposure, a silver image (preferably a black-and-white silver image) is obtained.

DEFINITIONS

As used herein:

In the descriptions of the photothermographic materials prepared by the present invention, "a" or "an" component refers to "at least one" of that component (for example, the specific phosphors described herein).

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising a support and at least one photothermographic emulsion layer or a photothermographic set of emulsion layers, wherein the photosensitive silver halide and the source of reducible silver ions are in one layer and the other essential components or desirable additives are distributed, as desired, in the same layer or in an adjacent coated layer. These materials also include multilayer constructions in which one or more imaging components are in different layers, but are in "reactive association". For example, one layer can include the non-photosensitive source of reducible silver ions and another layer can include the reducing agent and/or photosensitive silver halide.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

"Catalytic proximity" or "reactive association" means that the reactive components are in the same layer or in adjacent layers so that they readily come into contact with each other during imaging and thermal development.

"Emulsion layer", "imaging layer", or "photothermographic emulsion layer" means a layer of a photothermographic material that contains the photosensitive silver halide (when used) and/or non-photosensitive source of reducible silver ions. Such layers can also contain additional essential components and/or desirable additives. These layers are usually on what is known as the "frontside" of the support, but they can also be on both sides of the support.

"Photocatalyst" means a photosensitive compound such as silver halide that, upon exposure to radiation, provides a compound that is capable of acting as a catalyst for the subsequent development of the image-forming material.

Many of the chemical components used herein are provided as a solution. The term "active ingredient" means the amount or the percentage of the desired chemical component contained in a sample. All amounts listed herein are the amount of active ingredient added.

"Ultraviolet region of the spectrum" refers to that region of the spectrum less than or equal to 410 nm (preferably from about 100 nm to about 410 nm) although parts of these ranges may be visible to the naked human eye. More preferably, the ultraviolet region of the spectrum is the region of from about 190 to about 405 mm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, contrast, Dmin, and Dmax have conventional definitions known in the imaging arts.

In photothermographic materials, the term Dmin is considered herein as image density achieved when the photothermographic material is thermally developed without prior exposure to radiation. It is the average of eight lowest density values on the exposed side of the fiducial mark.

The term "Developed Density" is the maximum image density achieved in the imaged area when the photothermographic material is imaged and then thermally developed.

The sensitometric term absorbance is another term for optical density (OD).

"SP-2" (Speed-2) is Log 1/E+4 corresponding to the density value of 1.00 above Dmin where E is the exposure in ergs/cm$^2$.

"AC-1" (Average Contrast-1) is the absolute value of the slope of the line joining the density points of 0.60 and 2.00 above Dmin.

"AC-2" (Average Contrast-2) is the absolute value of the slope of the line joining the density points of 1.00 and 2.40 above Dmin.

"Transparent" means capable of transmitting visible light or imaging radiation without appreciable scattering or absorption.

As used herein, the phrase "organic silver coordinating ligand" refers to an organic molecule capable of forming a bond with a silver atom. Although the compounds so formed are technically silver coordination compounds they are also often referred to as silver salts.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the skilled artisan as not being inert or harmless.

*Research Disclosure* is a publication of Kenneth Mason Publications Ltd., Dudley House, 12 North Street, Emsworth, Hampshire PO10 7DQ England. It is also available from Emsworth Design Inc., 147 West 24th Street, New York, N.Y. 10011.

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide generally having up to 10 mol % silver iodide.

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetrazaindene (such as 4-hydroxy-6-methyl-1,3,3a,7-tetrazaindene or an N-heterocyclic compound comprising at least one mercapto group (such as 1-phenyl-5-mercaptotetrazole) as described in U.S. Pat. No. 6,413,710 (Shor et al.) that is incorporated herein by reference.

The photosensitive silver halide can be added to (or formed within) the emulsion layer(s) in any fashion as long as it is placed in catalytic proximity to the non-photosensitive source of reducible silver ions.

The silver halides may be preformed and prepared by an ex-situ process, and then added to and physically mixed with the non-photosensitive source of reducible silver ions.

It is also useful to form the non-photosensitive source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the source of reducible silver ions in the presence of silver halide provides a more intimate mixture of the two materials [see, for example U.S. Pat. No. 3,839,049 (Simons)] to provide a "preformed soap". Such grains are particularly preferred when the non-photosensitive silver salt is a silver salt of a carboxylic acid.

Preformed silver halide emulsions used in the material of this invention can be prepared by aqueous or organic processes and can be unwashed or washed to remove soluble salts. Soluble salts can be removed by any desired procedure for example as described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromosuccinimide or pyridinium hydrobromide perbromide) can be used. The details of such in-situ generation of silver halide are well known and described for example in U.S. Pat. No. 3,457,075 (Morgan et al.).

Additional methods of preparing silver halides and organic silver salts and blending them are described in *Research Disclosure*, June 1978, item 17029, U.S. Pat. No. 3,700,458 (Lindholm), U.S. Pat. No. 4,076,539 (Ikenoue et al.), JP Kokai 49-013224 (Fuji), JP Kokai 50-017216 (Fuji), and JP Kokai 51-042529 (Fuji).

The silver halide grains used in the imaging formulations can vary in average diameter of up to several micrometers (μm) depending on the desired use. Preferred silver halide grains are those having an average particle size of from about 0.01 to about 1.5 μm, more preferred are those having an average particle size of from about 0.03 to about 1.0 μm, and most preferred are those having an average particle size of from about 0.05 to about 0.8 μm.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

In some embodiments of this invention, the silver halide grains are provided predominantly (based on at least 50 mol % silver) as tabular silver halide grains that are considered "ultrathin" and have an average thickness of at least 0.02 μm and up to and including 0.10 μm. Preferably, an average thickness of at least 0.03 μm and more preferably of at least 0.04 μm, and up to and including 0.08 μm and more preferably up to and including 0.07 μm. The aspect ratio of these tabular grains is at least 5:1 (preferably at least 10:1, and more preferably at least 15:1) and generally up to 50:1. In addition, these tabular grains have an equivalent circular diameter ECD of at least 0.5 μm, preferably at least 0.75 μm, and more preferably at least 1.0 μm. The ECD can be up to and including 8 μm, preferably up to and including 6 μm, and more preferably up to and including 4 μm. Such grains are particularly preferred when the non-photosensitive silver salt is a silver salt of an imino group and the reducing agent is an ascorbic acid compound. Grains of this type, methods of their preparation, and characterization are described in U.S. Pat. No. 6,576,410 (Zou et al.) that is incorporated herein by reference.

The ultrathin tabular silver halide grains can also be doped using one or more of the conventional metal dopants known for this purpose including those described in *Research Disclosure* item 38957, September, 1996 and U.S. Pat. No. 5,503,970 (Olin et al.), incorporated herein by reference. Preferred dopants include iridium (III or IV) and ruthenium (II or III) salts. Particularly preferred silver halide grains are ultrathin tabular grains containing iridium-doped thiazole ligands. Such ultrathin tabular grains and their method of preparation are described in copending and commonly assigned U.S. Ser. No. 10/826,708 (filed on Apr. 16, 2004 by Olin et al.) that is incorporated herein by reference.

The one or more light-sensitive silver halides are preferably present in an amount of from about 0.005 to about 0.5 mole, more preferably from about 0.01 to about 0.4 mole, and most preferably from about 0.03 to about 0.3 mole, per mole of non-photosensitive source of reducible silver ions.

Chemical Sensitization

The photothermographic emulsions useful in the present invention can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP 0 915 371A1 (Lok et al.).

Certain substituted and unsubstituted thiourea compounds can be used as chemical sensitizers including those described in U.S. Pat. No. 6,368,779 (Lynch et al.) that is incorporated herein by reference.

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.), that are both incorporated herein by reference.

Combinations of gold(III)-containing compounds and either sulfur-, tellurium-, or selenium-containing compounds are also useful as chemical sensitizers as described in U.S. Pat. No. 6,423,481 (Simpson et al.) that is also incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes.

Other useful sulfur-containing chemical sensitizing compounds that can be decomposed in an oxidized environment are the diphenylphosphine sulfide compounds represented by the following Structure (PS):

(PS)

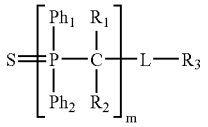

wherein $Ph_1$ and $Ph_2$ are the same or different phenyl groups, $R_1$ and $R_2$ are each independently hydrogen or an alkyl or phenyl group, L is a direct bond or a divalent linking group, m is 1 or 2 and when m is 1, $R_3$ is a monovalent group and when m is 2, $R_3$ is a divalent aliphatic linking group having 1 to 20 carbon, nitrogen, oxygen, or sulfur atoms in the chain. Such compounds are described in more detail in copending and commonly assigned U.S. Ser. No. 10/731,251 (filed Dec. 9, 2003 by Simpson, Burleva, and Sakizadeh), now U.S. Patent Application Publication 2005/0123870, which is incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology.

Spectral Sensitizers

The photosensitive silver halides used in the photothermographic materials of the invention may be spectrally sensitized with one or more spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothernographic emulsion, but are generally added after chemical sensitization is achieved.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kübodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP Kokai 2000-063690 (Tanaka et al.), JP Kokai 2000-112054 (Fukusaka et al.), JP Kokai 2000-273329 (Tanaka et al.), JP Kokai 2001-005145 (Arai), JP Kokai 2001-064527 (Oshiyama et al.), and JP Kokai 2001-154305 (Kita et al.), can be used in the practice of the invention. All of the publications noted above are incorporated herein by reference. Useful spectral sensitizing dyes are also described in *Research Disclosure*, December 1989, item 308119, Section IV and *Research Disclosure,* 1994, item 36544, section V.

Teachings relating to specific combinations of spectral sensitizing dyes also provided in U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat. Such dyes are described in U.S. Pat. No. 4,524,128 (Edwards et al.), JP Kokai 2001-109101 (Adachi), JP Kokai 2001-154305 (Kita et al.), and JP Kokai 2001-183770 (Hanyu et al.).

Dyes may be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the photothernographic materials of this invention can be any metal-organic compound that contains reducible silver (1+) ions. Such compounds are generally silver salts of silver coordinating ligands that are comparatively stable to light and forms a silver image when heated to 50° C. or higher in the presence of an exposed silver halide and a reducing agent.

In some embodiments, silver salts of organic acids including silver salts of long-chain aliphatic or aromatic carboxylic acids are preferred. The chains typically contain 10 to 30, and preferably 15 to 28, carbon atoms. Examples thereof include a silver salt of an aliphatic carboxylic acid or a silver salt of an aromatic carboxylic acid (such silver benzoates). Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver carboxylates.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α- (on a hydrocarbon group) or ortho- (on an aromatic group) position can also be used as described in U.S. Pat. No. 5,491,059 (Whitcomb). Silver salts of dicarboxylic acids are also useful as well as silver salts of sulfonates as described for example in U.S. Pat. No. 4,504,575 (Lee). Useful silver salts of sulfosuccinates are described for example in EP 0 227 141 A1 (Leenders et al.). Moreover, silver salts of acetylenes can also be used as described, for example in U.S. Pat. No. 4,761,361 (Ozaki et al.) and U.S. Pat. No. 4,775,613 (Hirai et al.).

Silver salts of compounds containing mercapto or thione groups and derivatives thereof can also be used. Such heterocyclic nuclei include, but are not limited to, triazoles, oxazoles, thiazoles, thiazolines, imidazoles, diazoles, pyridines, and triazines, as described for example in U.S. Pat. No. 4,123,274 (Knight et al.) and U.S. Pat. No. 3,785,830 (Sullivan et al.).

In some embodiments, a silver salt of a compound containing an imino group is preferred, especially in aqueous-based imaging formulations. Preferred examples of these compounds include, but are not limited to, silver salts of benzotriazole and substituted derivatives thereof (for example, silver methyl-benzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof.

In some embodiments of the present invention the non-photosensitive source of reducible silver ions comprises:

a) a silver salt of a fatty acid having from 10 to 30 carbon atoms, or a mixture of the silver salts, at least one of which is silver behenate, b) a silver salt of a compound containing an imino group, or a mixture of the silver salts, at least one of which is silver benzotriazole, or c) a mixture of a) and b).

In some embodiments it is convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.) that is incorporated herein by reference, wherein a core has one or more silver salts and a shell has one or more different silver salts.

Other useful sources of non-photosensitive reducible silver ions are the silver dimer compounds that comprise two different silver salts as described in U.S. Pat. No. 6,472,131 (Whitcomb) that is incorporated herein by reference.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Published Application 2004-0023164 (Bokhonov et al.) that is incorporated herein by reference.

The one or more non-photosensitive sources of reducible silver ions are preferably present in an amount of from about 5% to about 70%, and more preferably from about 10% to about 50%, based on the total dry weight of the emulsion layers. Alternatively, the amount of the sources of reducible silver ions is generally from about 0.001 to about 0.2 mol/$m^2$ of the dry photothermographic material (preferably from about 0.01 to about 0.05 mol/$m^2$).

The total amount of silver (from all silver sources) in the photothermographic materials is generally at least 0.002 mol/$m^2$ and preferably from about 0.01 to about 0.05 mol/$m^2$. The total silver coverage is at least 0.5 g/$m^2$ and generally from about 1 to about 5 g/$m^2$.

Reducing Agents

The reducing agent (or reducing agent composition comprising two or more components) for the source of reducible silver ions can be any material (preferably an organic material) that can reduce silver (1+) ion to metallic silver. The "reducing agent" is sometimes called a "developer" or "developing agent".

Conventional photographic developers can be used as reducing agents, including aromatic di- and tri-hydroxy compounds, aminophenols, p-phenylenediamines, alkoxynaphthols, pyrazolidin-3-one type reducing agents, pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid as described below), and other materials readily apparent to one skilled in the art.

When a silver benzotriazole silver source is used, ascorbic acid reducing agents are preferred. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792A1 (Passarella et al.), EP 0 573 700A1 (Lingier et al.), EP 0 588 408A1 (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), Japanese Kokai 7-56286 (Toyoda), U.S. Pat. No. 2,688,549 (James et al.), and *Research Disclosure*, item 37152, March 1995. D-, L-, or D,L-ascorbic acid (and alkali metal salts thereof) or isoascorbic acid (or alkali metal salts thereof) are preferred. Mixtures of these developing agents can be used if desired.

When a silver carboxylate silver source is used, one or more hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis(hydroxyphenyl) methanes (that is bisphenols), hindered phenols, and hindered naphthols, each of which may be variously substituted. U.S. Pat. No. 3,094,417 (Workman) and U.S. Pat. No. 5,262,295 (Tanaka et al.), both incorporated herein by reference, describe useful hindered phenols, including 1,1'-bis(2-hydroxy-3,5-dimethylphenyl)-3,5,5-trimethylhexane (NONOX® or PERMANAX® WSO) and 2,2'-isobutylidene-bis(4,6-dimethylphenol) (LOWINOX® 221B46).

Still another useful class of reducing agents includes polyhydroxy spiro-bis-indane compounds described as photographic tanning agents in U.S. Pat. No. 3,440,049 (Moede).

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.). All of these patents are incorporated herein by reference.

More specific alternative reducing agents that have been disclosed in dry silver systems including amidoximes, azines, a combination of aliphatic carboxylic acid aryl hydrazides and ascorbic acid, a combination of polyhydroxybenzene and hydroxylamine, a reductone and/or a hydrazine, piperidinohexose reductone or formyl-4-methylphenylhydrazine, hydroxamic acids, a combination of azines and sulfonamidophenols, α-cyanophenylacetic acid derivatives, bis-o-naphthols, a combination of bis-o-naphthol and a 1,3-dihydroxybenzene derivative, 5-pyrazolones, reductones, sulfonamidophenol reducing agents, indane-1,3-diones, chromans, 1,4-dihydropyridines, ascorbic acid derivatives, and 3-pyrazolidones.

Useful co-developer reducing agents can also be used as described for example, in U.S. Pat. No. 6,387,605 (Lynch et al.) that is incorporated herein by reference.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds such as the compounds identified as HET-01 and HET-02 in U.S. Pat. No. 5,635,339 (Murray) and CN-01 through CN-13 in U.S. Pat. No. 5,545,515 (Murray et al.).

Various contrast enhancing agents can be used in some photothermographic materials with specific co-developers. Examples of useful contrast enhancing agents include, but are not limited to, hydroxylamines, alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

Aromatic di- and tri-hydroxy reducing agents can also be used in combination with hindered phenol reducing agents either together or in combination with one or more high contrast co-developing agents and co-developer contrast-enhancing agents.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes. The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second.

Useful reducing agents of this type include leuco dyes that form and release a dye upon oxidation by silver ion to form a visible color image including those described in U.S. Pat. No. 3,985,565 (Gabrielson et al.), U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), U.S. Pat. No. 4,932,792 (Grieve et al.), and U.S. Pat. No. 5,491,059 (noted above) and references cited therein.

The total amount of one or more dye-forming or releasing compound that can be used is generally from about 0.5 to about 25 weight % (preferably from about 1 to about 10 weight %) of the total weight of each imaging layer in which they are located.

Phosphors

Phosphors are materials that emit infrared, visible, or ultraviolet radiation upon excitation. The phosphors useful in this invention are sensitive to X-radiation and emit radiation primarily in the ultraviolet or near-ultraviolet region of the spectrum (that is, from about 100 to about 410 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet radiation. Multiple dopants may be used and thus the phosphor would include both "activators" and "co-activators". The phosphors useful in this invention are primarily "activated" phosphors that are selected from the following phosphors: rare earth phosphates, yttrium phosphates, or strontium phosphates, or fluoride-containing strontium borates also known as strontium fluoroborates. Preferably, the phosphors are cerium activated rare earth phosphates, or yttrium phosphates, or europium activated strontium fluoroborates.

The phosphors useful in the present invention preferably have a zircon or monazite crystal structure. Phosphors with a monazite crystal structure are most preferred.

In some embodiments of this invention, the phosphors are europium activated strontium fluoroborates having a composition defined from the following Structure (I):

$$M_aF_bB_cO_d{:}eEu \quad (I)$$

wherein M is strontium, or a mixture of metals containing strontium and one or more of the metals Mg or Ca, F is fluoride, B is boron, O is oxygen, $0<a\leqq1.5$, $0<b\leqq0.5$, $2<c\leqq5$, $3<d\leqq7$, $0<e\leqq0.25$, and $0<a+e\leqq2$.

The preparation of compounds of Structure (I) are described in U.S. Pat. No. 3,431,215 (Chenot), JP 50-092281 (Westinghouse Electric Corp., USA), and by K. H. Butler in "*Fluorescent Lamp Phosphors*," The Pennsylvania State University Press, University Park, Pa., 1980, Chapter 4, pp. 49–60.

In other embodiments, the phosphors are strontium phosphates or strontium pyrophosphates having a composition defined by the following Structure (II) as said X-radiation-sensitive phosphor:

$$M^1{}_{a1}M^2{}_{b1}M^3{}_{c1}P_{d1}O_{e1} \quad (II)$$

wherein $M^1$ and $M^2$ are different metals selected from the group consisting of Mg, Ca, Sr, and Zn, $M^3$ is one or more of the metals Eu, Mn, Sn, and Pb, $0<a1\leqq2$, $0<b1\leqq1$, $0<c1\leqq0.2$, $0<a1+b1+c1\leqq2$, $0<d1\leqq4$, and $0<e1\leqq10$.

The preparation of compounds of Structure (II) are described for example, by Butler in "*Fluorescent Lamp Phosphors*" (noted above) and by M. V. Hoffman, *J. Electrochem. Soc.,* 1968, 115(5), 560–563.

In still other embodiments, the phosphors are cerium and strontium activated and co-activated rare earth phosphates or cerium and strontium activated yttrium phosphates such as those defined by the following Structure (III) as said X-radiation-sensitive phosphor:

$$M^1{}_{a2}M^2{}_{b2}M^3{}_{c2}M^4{}_{d2}P_{e2}O_f \quad (III)$$

wherein $M^1$ is lanthanum or yttrium, $M^2$ is cerium, $M^3$ is gadolinium, ytterbium, or a mixture thereof, $M^4$ is strontium or a strontium-containing mixture of alkaline earth metals, $0<a2\leqq1$, $0<b2\leqq0.6$, $0<c2\leqq0.5$, $0<d2\leqq0.1$, $0<a2+b2+c2+d2\leqq(e2+1)$, and $0<f\leqq(4.5e2)$. In preferred embodiments, c2 and d2 are independently at least $10^{-6}$.

Of the phosphors defined by Structure (III), the most preferred phosphors have a monazite crystal structure and a composition that is defined by the following Structure (IV):

$$M^1{}_{a2}M^2{}_{b2}M^4{}_{d2}P_{e2}O_f \quad (IV)$$

wherein $M^1$ is lanthanum, $M^2$ is cerium, $M^4$ is strontium or a strontium-containing mixture of alkaline earth metals, $0.5<a2\leqq1$, $0.005<b2\leqq0.3$, $0\leqq d2\leqq0.1$, $0<a2+b2+d2\leqq(e2+1)$, and $(3.5e2)<f\leqq(4.5e2)$. In preferred embodiments, d2 is at least $10^{-6}$.

The preparation of compounds of Structures (III) and (IV) are described in U.S. Pat. No. 3,104,226 (Struck), JP 01-126390 (Okada et al.) and Butler, "*Fluorescent Lamp Phosphors*," The Pennsylvania State University Press, University Park, Pa., 1980, Chapter 4, pp. 49–60, Chapter 14 pp. 167–169, and Chapter 16, pp. 258–286. The crystal structures of preferred phosphors defined by structures (III) and structure (IV) are given in A. T. Aldred, *Acta Cryst.,* 1984, B40, 569–574.

Useful phosphors can be obtained from a number of commercial sources including Nichia Corporation of America and Osram Sylvania. The list below gives the peak emission wavelength as well the crystallographic structure type determined by X-ray powder diffraction for phosphors CP-1, CP-2, and P-1 through P-5 used in the examples below.

The commercially available form of P-1 and P-2 used in the practice of this invention were analyzed and found to include very small amounts of Sr, Mg, and Ca as co-activators. The monazite crystal structure of the phosphor was confirmed by X-ray powder diffraction. As one skilled in the art would understand, many commercial phosphors are rarely completely free of activators or co-activators that may not be specifically listed in the chemical formulae used in the trade to define them. Such activators or co-activators may be present at levels of at least 1 ppm.

| Phosphor | Composition | Peak Emission Wavelength(nm) | Structure Type | Mean particle size (microns) |
|---|---|---|---|---|
| CP-1 | $YTaO_4$:Sr | 325 nm | M'-$YTaO_4$ | 4 |
| CP-2 | $YTaO_4$:Sr | 325 nm | M'-$YTaO_4$ | 7.5 |
| P-1 | $LaPO_4$:Ce | 318 nm | Monazite | 4.6 |
| P-2 | $YPO_4$:Ce | 357 nm | Zircon | 10 |
| P-3 | $SrB_4O_7$:Eu,F | 371 nm | $SrB_4O_7$ | 10 |
| CP-3 | $BaMgAl_{11}O_{19}$:Ce | 344 nm | β-$Al_2O_3$ | 15 |
| P-5 | $Sr_2P_2O_7$:Eu | 420 nm | $Sr_2P_2O_7$ | 11 |

M'-$YTaO_4$ refers to the M' form of yttrium tantalate, (see M L. H. Brixner and H. Y. Chen, J. Electrochem. Soc., 1983, 130(12), 2435–43). M'-Type $YTaO_4$ belongs to a monoclinic space group.

Examples of useful phosphors include, but are not limited to, $LaPO_4$:Ce (P-1), $YPO_4$:Ce (P-2), $SrB_4O_7$:Eu,F (P-3), and $Sr_2P_2O_7$:Eu (P-5). Phosphors P-1 and P-2 are most preferred.

Other examples of useful phosphors are those materials containing activators known to emit in the short wavelength visible region of the spectrum to the UV region of the spectrum between 100 nm and 450 nm. Examples of activators in phosphors that emit in this region include thulium, lead, thallium, bismuth, and europium in the divalent state, tin, copper, silver, titanium, niobium, cerium, and gadolinium. Phosphors containing halogen co-activators such as fluoride are also useful. The phosphor can be selected from those UV emitting phosphors disclosed by J. W. Gilliland and M. S. Hall, *Electrochem. Tech.* 1966, 4(7/8), 378–382. Preferred phosphors can additionally be selected from one or a mixture of cerium activated phosphors and scintillators reviewed by M. Weber in "Cerium-Activated Crystal and Glass Scintillators" [*Heavy Scintillator Science Industrial Applications*, Proceedings of "Cryst. 2000", Int. Workshop, 1992, 1993, pp. 99–124, De Notaristefani, F, Lecoq, P., Schneegans, Eds., Frontieres, Gif-sur-yvette, France.] Useful phosphors for this invention include cerium activated rare earth silicate where the rare earth is selected from gadolinium, lanthanum, or yttrium, gadolinium activated yttrium and lanthanum orthosilicates, cerium activated yttrium, gadolinium, or lanthanum aluminate with the perovskite structure, cerium or gadolinium activated lithium-magnesium-aluminum silicate glass, cerium activated zinc-gadolinium borate glass, and cerium activated cesium-gadolinium fluoride phosphor.

One or more phosphors can be incorporated into the photothermographic materials of this invention in an amount of at least 0.5 mole and preferably from about 1 to about 20 mole, per mole of total silver wherein the total silver (from all sources) present in said material is at least 0.002 mol/$m^2$. Thus, a mixture of phosphors can be used.

While the phosphors can be incorporated into any imaging layer on one or both sides of the support, it is preferred that they be in the same layer(s) as the photosensitive silver halide(s) on one or both sides of the support. Because of the size of the phosphors used in the invention, generally the layers in which they are incorporated (usually one or more emulsion layers) have a dry coating weight of phosphor of at least 5 g/$m^2$, and preferably from about 5 g/$m^2$ to about 200 g/$m^2$. Preferably, the one or more phosphors, the photosensitive silver halide, the non-photosensitive source of reducible silver ions, and the binder are incorporated within the same imaging layer that has a dry coating weight of from about 100 to about 800 g/$m^2$. Most preferably the imaging layer has a dry coating weight of between 300 to 400 g/$m^2$.

Other Addenda

The photothermographic materials of this invention can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, Dmin, speed, or fog), it may be preferable to add one or more heteroaromatic mercapto compounds or heteroaromatic disulfide compounds of the formulae Ar—S-$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Useful heteroaromatic mercapto compounds are described as supersensitizers for infrared photothermographic materials in EP 0 559 228B1 (Philip Jr. et al.).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

A heteroaromatic mercapto compound is generally present in an emulsion layer in an amount of at least 0.0001 mole (preferably from about 0.001 to about 1.0 mole) per mole of total silver in the emulsion layer.

The photothermographic materials can be further protected against the production of fog and can be stabilized against loss of sensitivity during storage. Other suitable antifoggants and stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described in U.S. Pat. No. 5,594,143 (Kirk et al.) and U.S. Pat. No. 5,374,514 (Kirk et al.), and 2-(tribromomethylsulfonyl) quinoline compounds as described in U.S. Pat. No. 5,460,938 (Kirk et al.).

Stabilizer precursor compounds capable of releasing stabilizers upon application of heat during development can also be used as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful for post-processing print stabilizing as described in U.S. Pat. No. 6,171,767 (Kong et al.).

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), vinyl sulfones as described in U.S. Pat. No. 6,143,487 (Philip, Jr. et al.), diisocyanate compounds as described in EP 0 600 586A1 (Philip, Jr. et al.), and tribromomethylketones as described in EP 0 600 587A1 (Oliff et al.).

Preferably, the photothermographic materials include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants are polyhalo antifoggants, such as those having a $—SO_2C(X')_3$ group wherein X' represents the same or different halogen atoms.

The photothermographic materials of this invention may also include one or more thermal solvents (or melt formers) such as disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

It is often advantageous to include a base-release agent or base precursor in the photothermographic materials. Representative base-release agents or base precursors include guanidinium compounds, such as guanidinium trichloroacetate, and other compounds that are known to release a base but do not adversely affect photographic silver halide materials, such as phenylsulfonyl acetates. Further details are provided in U.S. Pat. No. 4,123,274 (Knight et al.).

The use of "toners" or derivatives thereof that improve the image are highly desirable components of the photothermographic materials. Toners are compounds that when added to the photothermographic imaging layer(s) shift the color of the developed silver image from yellowish-orange to brown-black or blue-black. Generally, one or more toners described herein are present in an amount of about 0.01% by weight to about 10%, and more preferably about 0.1% by weight to about 10% by weight, based on the total dry weight of the layer in which it is included. Toners may be incorporated in the photothermographic emulsion layer(s) or in an adjacent non-imaging layer.

Compounds useful as toners are described, for example, in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Phthalazine and phthalazine derivatives [such as those described in U.S. Pat. No. 6,146,822 (Asanuma et al.), incorporated herein by reference], phthalazinone, and phthalazinone derivatives are particularly useful toners.

Additional useful toners are substituted and unsubstituted mercaptotriazoles as described for example in U.S. Pat. No. 3,832,186 (Masuda et al.), U.S. Pat. No. 6,165,704 (Miyake et al.), U.S. Pat. No. 5,149,620 (Simpson et al.), and U.S. Published Application 2004-0013984 (Lynch et al) and U.S. Published Application 2004-0013985 (Lynch et al.), all of which are incorporated herein by reference.

Also useful are the phthalazine compounds described in commonly assigned U.S. Pat. No. 6,605,481 (Ramsden et al.), the triazine thione compounds described in U.S. Pat. No. 6,703,191 (Lynch et al.), and the heterocyclic disulfide compounds described in U.S. Ser. No. 10/384,244 (filed Mar. 7, 2003 by Lynch and Ulrich), now U.S. Pat. No. 6,737,227, all of which are incorporated herein by reference.

The photothermographic materials prepared by the methods of this invention can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in copending and commonly assigned U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described for example, in U.S. Pat. No. 6,465,162 (Kong et al), and GB 1,565,043 (Fuji Photo). All of these patents and patent applications are incorporated herein by reference.

Binders

The chemically sensitized photosensitive silver halide, the non-photosensitive source of reducible silver ions, the reducing agent, phosphor, and any other imaging layer additives used in the present invention are generally combined with one or more binders that are either hydrophilic or hydrophobic. Thus, either aqueous or organic solvent-based formulations can be used to prepare the thermally developable materials of this invention. Mixtures of either or both types of binders can also be used.

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available under the names BUTVAR® (Solutia, Inc.) and PIOLOFORM® (Wacker Chemical Company).

Water-dispersible latexes of hydrophobic polymers may also be used either alone to provide binders or in combination with other binders.

Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure*, item 38957, noted above).

Hardeners for various binders may be present if desired. Useful hardeners are well known and include diisocyanate compounds as described for example, in EP 0 600 586 B1 (Philip, Jr. et al.), vinyl sulfone compounds as described in U.S. Pat. No. 6,143,487 (Philip, Jr. et al.), and EP 0 640 589 A1 (Gathmann et al.), aldehydes and various other hardeners as described in U.S. Pat. No. 6,190,822 (Dickerson et al.).

Where the proportions and activities of the photothermographic materials require a particular developing time and temperature, the binder(s) should be able to withstand those conditions. When a hydrophobic binder is used, it is preferred that the binder does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer.

Support Materials

The photothermographic materials prepared by this invention comprise a polymeric support that is preferably a flexible, transparent film that has any desired thickness and is composed of one or more polymeric materials, depending upon their use. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins, polycarbonates, and polystyrenes. Preferred supports are composed of polymers having good heat stability, such as polyesters and polycarbonates. Polyethylene terephthalate film is a particularly preferred support. Support materials may also be treated or annealed to reduce shrinkage and promote dimensional stability.

It is also useful to use supports comprising dichroic mirror layers as described in U.S. Pat. No. 5,795,708 (Boutet), incorporated herein by reference.

Also useful are transparent, multilayer, polymeric supports comprising numerous alternating layers of at least two different polymeric materials that preferably reflect at least 50% of actinic radiation in the range of wavelengths to which the photothermographic material is sensitive. Such polymeric supports are described in U.S. Pat. No. 6,630,283 (Simpson et al.), incorporated herein by reference.

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Photothermographic Formulations

An organic solvent-based coating formulation for the photothermographic emulsion layer(s) can be prepared by mixing the photothermographic emulsion prepared according to the present invention with one or more hydrophobic binders in a suitable solvent system that usually includes an organic solvent, such as toluene, 2-butanone (methyl ethyl ketone), acetone, or tetrahydrofuran.

Alternatively, the photothermographic emulsion formulation can be composed with a hydrophilic binder (such as gelatin, a gelatin-derivative, or a cellulosic material) or a water-dispersible polymer in the form of a latex in water or water-organic solvent mixtures to provide aqueous-based coating formulations.

Photothermographic materials prepared by this invention can contain plasticizers and lubricants such as poly(alcohols) and diols of the type described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents including those described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

The photothermographic materials of this invention can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles described in U.S. Pat. No. 6,689,546 (LaBelle et al.). All of the above patents and patent applications are incorporated herein by reference.

Still other conductive compositions include one or more fluoro-chemicals each of which is a reaction product of $R_f$—$CH_2CH_2$—$SO_3H$ with an amine wherein $R_f$ comprises 4 or more fully fluorinated carbon atoms as described in U.S. Pat. No. 6,699,648 (Sakizadeh et al.) that is incorporated herein by reference.

Additional conductive compositions include one or more fluoro-chemicals described in more detail in copending and commonly assigned U.S. Ser. No. 10/265,058 (filed Oct. 4, 2002 by Sakizadeh, LaBelle, and Bhave) that is incorporated herein by reference.

Layers to promote adhesion of one layer to another in photothermographic materials are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), and U.S. Pat. No. 6,420,102 (Bauer et al.), and U.S. Pat. No. 6,667,148 (Rao et al.), and copending and commonly assigned U.S. Ser. No. 10/351, 814 (filed Jan. 27, 2003 by Hunt), now U.S. Pat. No. 6,746,831 (Hunt), all incorporated herein by reference.

The photothermographic formulations described herein (including the photothermographic emulsion formulation) can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

For example, after or simultaneously with application of the photothermographic emulsion formulation to the support, a protective overcoat formulation can be applied over the emulsion formulation, simultaneously or subsequently.

Preferably, two or more layer formulations are applied simultaneously to a film support using slide coating, the first layer being coated on top of the second layer while the second layer is still wet. The first and second fluids used to coat these layers can be the same or different solvents.

In other embodiments, a "carrier" layer formulation comprising a single-phase mixture of the two or more polymers described above may be applied directly onto the support and thereby located underneath the emulsion layer(s) as described in U.S. Pat. No. 6,355,405 (Ludemann et al.), incorporated herein by reference. The carrier layer formulation can be applied simultaneously with application of the photothermographic emulsion layer formulation.

Mottle and other surface anomalies can be reduced in the photothermographic materials by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

While the first and second layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

It is also contemplated that the photothermographic materials of this invention can include photothermographic emulsion layers on both sides of the support and/or an antihalation underlayer beneath at least one emulsion layer.

To promote image sharpness, photothermographic materials of the present invention can contain one or more layers containing acutance and/or antihalation dyes. These dyes are chosen to have absorption close to the exposure wavelength and are designed to absorb scattered light. One or more antihalation compositions may be incorporated into one or more antihalation backing layers, antihalation underlayers, or as antihalation overcoats. Additionally, one or more acutance dyes may be incorporated into one or more frontside layers.

Dyes useful as antihalation and acutance dyes include squaraine dyes described in U.S. Pat. No. 5,380,635 (Gomez et al.), U.S. Pat. No. 6,063,560 (Suzuki et al.), and EP 1 083 459A1 (Kimura), indolenine dyes described in EP 0 342 810A1 (Leichter), and cyanine dyes described in U.S. Published Application 2003-0162134 (Hunt et al.), all incorporated herein by reference.

It is also useful to employ compositions including acutance or antihalation dyes that will decolorize or bleach with heat during processing, as described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), JP Kokai 2001-142175 (Hanyu et al.), and JP Kokai 2001-183770 (Hanye et al.). Useful bleaching compositions are described in JP Kokai 11-302550 (Fujiwara), JP Kokai 2001-109101 (Adachi), JP Kokai 2001-51371 (Yabuki et al.), and JP Kokai 2000-029168 (Noro). All of the noted publications are incorporated herein by reference.

Other useful heat-bleachable backside antihalation compositions can include an infrared radiation absorbing compound such as an oxonol dye and various other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

In some embodiments, the photothermographic materials prepared by this invention include a surface protective layer over one or more imaging layers on one or both sides of the support. In other embodiments, the photothermographic materials include a surface protective layer on the same side of the support as the one or more photothermographic emulsion layers and a layer on the backside that includes an antihalation and/or conductive antistatic composition. A separate backside surface protective layer can also be included in these embodiments.

Imaging/Development

The photothermographic materials of the present invention can be imaged in any suitable manner consistent with the type of material using any suitable imaging source (typically X-radiation). Other embodiments may be sensitive to radiation in the range of from about at least 300 nm to about 1400 nm.

Imaging can be achieved by exposing the X-radiation photothermographic materials of this invention to a suitable source of X-radiation to provide a latent image. Suitable exposure means are well known and include sources of X-radiation including medical, mammography, dental, and industrial X-ray units.

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds.

Heating can be accomplished using any suitable heating means. A preferred beat-development procedure includes heating at from about 110° C. to about 160° C. for from about 3 to about 35 seconds.

Imaging Assemblies

The photothermographic materials of this invention are also useful in an imaging assembly comprising one or more phosphor intensifying screens adjacent the front and/or back of the photothermographic material. Such screens are well known in the art [for example, U.S. Pat. No. 4,865,944 (Roberts et al.) and U.S. Pat. No. 5,021,327 (Bunch et al.)]. An assembly (often known as a cassette), can be prepared by arranging the photothermographic material, and the one or more screens in a suitable holder and appropriately packaging them for transport and imaging uses.

In use, the phosphor intensifying screen can be positioned in "front" of the photothermographic material to absorb X-radiation and to emit electromagnetic radiation having a wavelength greater than 300 nm and to which the photothermographic material has been sensitized.

Double-coated X-radiation sensitive photothermographic materials (that is, materials having one or more thermally developable imaging layers on both sides of the support) are preferably used in combination with two intensifying screens, one screen in the "front" and one screen in the "back" of the material. The following examples are provided to illustrate the practice of the present invention and the invention is not meant to be limited thereby.

Materials and Methods for the Experiments and Examples:

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID® A-21 is an acrylic copolymer available from Rohm and Haas (Philadelphia, Pa.).

BUTVAR® B-79 is a polyvinyl butyral resin available from Solutia, Inc. (St. Louis, Mo.).

CAB 171-15S is a cellulose acetate butyrate resin available from Eastman Chemical Co. (Kingsport, Tenn.).

DESMODUR N3300 is an aliphatic hexamethylene diisocyanate that is available from Bayer Chemicals (Pittsburgh, Pa.).

KODAK ULTRASPEED® X-ray Film 4502 is a medical X-ray film available from Eastman Kodak Company (Rochester, N.Y.). It is developed using wet chemical processing.

PERMANAX® WSO (or NONOX®) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

MEK is methyl ethyl ketone (or 2-butanone).

PHP is pyridinium hydrobromide perbromide

Zonyl® FSN is a fluorosurfactant that is available from E. I. DuPont de Nemours & Co.(Wilmington, Del.).

Vinyl Sulfone-1 is described in U.S. Pat. No. 6,143,487 and is believed to have the following structure (VS-1).

(VS-1)

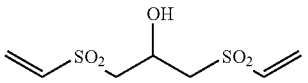

Bisvinyl sulfonyl methane (VS-2) is 1,1'(methylenebis(sulfonyl))-bis-ethene. It can be prepared as described in EP 0 640 589 A1 (Gathmann et al.) and is believed to have the following structure.

VS-1

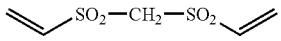

Antifoggant-A is tribromomethylsulfonylpyridine and is believed to have the following structure (AF-A).

(AF-A)

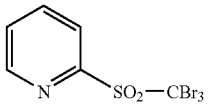

Antifoggant B is described in U.S. Pat. No. 5,686,228 and is believed to have the following structure (AF-B).

(AF-B)

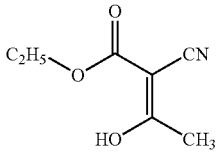

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the following structure.

(BC-1)

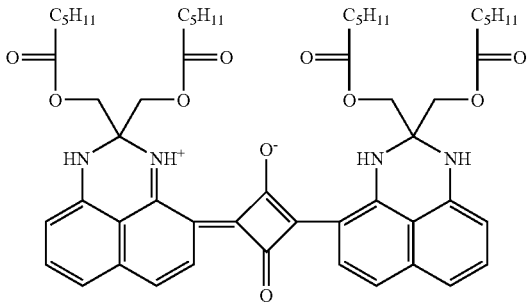

Compound CN-08 is described in U.S. Pat. No. 5,545,515 (Murray et al.) and is believed to have the following structure.

(CN-08)

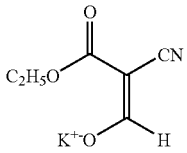

Compounds S-1 and S-2 are sulfur-containing chemical sensitizers. Compound Au-1 is a gold-containing chemical sensitizer. The structures of these compounds are shown below.

(S-1)

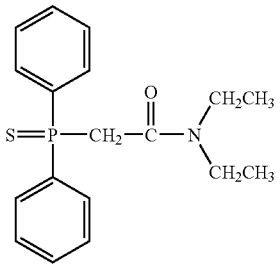

(S-2)

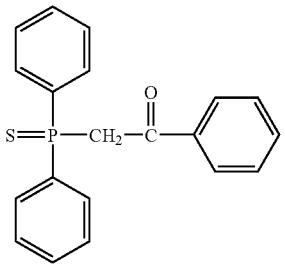

(Au-1)

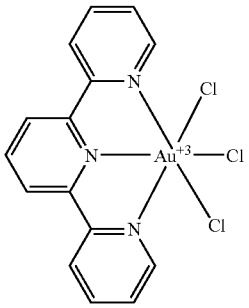

CTT is described in U.S. Pat. No. 6,296,998 (Eikenberry et al.) and is believed to have the following structure (SS-1a).

(SS-1a)

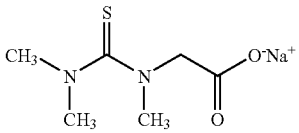

Blue sensitizing dye SSD-1 is believed to have the following structure.

(SSD-1)

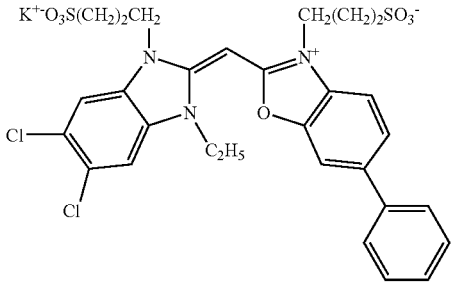

Compound T-1 is 2,4-dihydro-4-(phenylmethyl)-3H-1,2,4-triazole-3-thione and is believed to have the following structure shown (while drawn in the thione form it may also exist as the thiol tautomer).

(T-1)

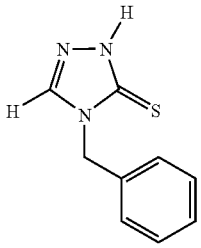

Phosphors CP-1, CP-2, P-1, and P-2 were obtained from Nichia America Corporation (Mountville, Pa.).

Phosphors P-3, P-4, and P-5 were obtained from Osram Sylvania Products, Inc. (Chemical and Metallurgical Products Division, Towanda, Pa.).

EXAMPLE 1

Use of Phosphor P-1 in Photothermographic Materials

The preparation of a photothermographic formulation was carried out as follows:

A preformed silver bromoiodide (98% Br, 2% I), silver carboxylate "soap" was prepared as described in U.S. Pat. No. 6,413,710 (Shor et al.). The average grain size was 0.20 μm. The photothermographic emulsions were chemically sensitized according to procedures described in U.S. Pat. No. 6,423,481 (Simpson et al.) using the materials and amounts shown below.

Photothermographic Emulsion Formulation:

To 198.9 g of this silver soap dispersion at 23.23% solids were added in order:

| Compound | Amount | Mix Time | Temp. |
|---|---|---|---|
| Compound S-1 | 8.2 ml of a solution of 0.0508 g in 8.64 g of MeOH | 40 minutes | 67° F. (19.4° C.) |
| Zinc Bromide | 0.169 g in 1.19 g of MeOH | 30 minutes | |
| PHP | 0.20 g in 1.58 g of MeOH | 60 minutes | |
| Cool | | 10 minutes | 61° F. (16.1° C.) |
| Compound Au-1 | 4.8 ml of a solution of 0.0052 g in 50 g of MeOH | 60 minutes | |
| Chlorobenzoyl benzoic acid | 1.42 g | 15 minutes | |
| Cool | | 20 minutes | 50° F. (10° C.) |

-continued

| Compound | Amount | Mix Time | Temp. |
|---|---|---|---|
| BUTVAR ® B-79 | 20 g | 30 minutes | |
| Antifoggant AF-A | 2.14 g in 24.2 g of MEK | 10 minutes | |
| DESMODUR ® N3300 | 0.63 g in 1.5 g of MEK | | |
| Phthalazine | 1.0 g in 5 g of MEK | 15 minutes | |
| Tetrachlorophthalic acid | 0.35 g in 2 g of MEK | | |
| 4-Methylphthalic acid | 0.45 g in 4 g of MEK | 15 minutes | |
| PERMANAX ® WSO | 10.6 g | 15 minutes | |

Protective Topcoat Formulation:

A protective topcoat for the photothermographic emulsion layer was prepared as follows:

| | |
|---|---|
| ACRYLOID ® A-21 | 0.58 g |
| CAB 171-15S | 14.9 g |
| MEK | 183.4 g |
| VS-1 | 0.3 g |
| Benzotriazole | 1.6 g |
| Antifoggant AF-A | 0.24 g |
| Antifoggant AF-B | 0.12 g |

The photothermographic emulsion and topcoat formulations were coated under safelight conditions using a dual knife coating machine onto a 7 mil (178 μm) blue-tinted polyethylene terephthalate support provided with a backside antihalation layer containing Dye BC-1 in CAB 171-15S resin binder. Samples were dried for 7 minutes at 87° C. The silver coating weights were approximately 2.25 to 2.28 g/m$^2$.

Samples of the photothermographic materials were imagewise exposed for $10^{-3}$ seconds using an EG&G Flash sensitometer equipped with both a P-16 filter and a 0.7 neutral density filter to provide continuous tone "wedges". Following exposure, the films were developed using a heated roll processor for 15 seconds at 122.2° C. to 122.8° C.

Densitometry measurements were made on a custom built computer-scanned densitometer and meeting ISO Standards 5-2 and 5-3. They are believed to be comparable to measurements from commercially available densitometers. Densities of the wedges were then measured with a computer densitometer using a filter appropriate to the sensitivity of the photothermographic material to obtain graphs of density versus log exposure (that is, D log E curves).

To a 25 g aliquot of the emulsion formulation described above was added 18.2 g of $YSrTaO_4$ (CP-1) phosphor (average size of 4.0 μM) or $LaPO_4$:Ce (P-1) phosphor (average size of 4.6 μm). The materials were mixed for an additional 5 minutes to prepare the final photothermographic coating formulations.

These solutions were coated to similar phosphor coating weights approximately from 80 to 82 g/m$^2$. The sensitometric results, shown below in TABLE I demonstrate slightly slower speed, lower contrast and a decreased Dmin when $LaPO_4$:Ce (P-1) is formulated with a standard emulsion formulation as compared to the $YSrTaO_4$ (CP-1) phosphor.

TABLE I

| Example | Phosphor | Dmin | SP-2 | AC-1 |
|---|---|---|---|---|
| 1-1 | CP-1 | 0.83 | 4.35 | 2.66 |
| 1-2 | P-1 | 0.76 | 4.25 | 2.45 |

The X-ray sensitometric response of these photothermographic materials with CP-1 or P-1 phosphor was determined by exposing the samples using a Fischer X-ray unit operating at 200 mA and 76 KeV filtered with a 3.0 mm sheet of aluminum. The samples were placed on a table set at 85.5 cm from the X-ray source. A series of X-ray exposures of constant intensity and exposure times of from 0.05 to 1.5 seconds was made. After samples were exposed they were processed in a manner similar as described in Example 1.

The density of these samples were measured with a X-rite 310 densitometer using the Status A filters and measured with the visible filter. The sensitometric results, shown below in TABLE II, demonstrate sensitivity to X-rays when the P-1 phosphor is formulated with the photothermographic material.

TABLE II

| Example | Phosphor | (Developed Density − Dmin) at 0.4 sec | (Developed Density − Dmin) at 0.8 sec |
|---|---|---|---|
| 1-1 | CP-1 | 1.25 | 2.08 |
| 1-2 | P-1 | 0.70 | 1.33 |

EXAMPLE 2

Use of Phosphor CP-1 in Non-Chemically Sensitized Photothermographic Materials The preparation of the photothermographic formulation was the same as described on Example 1 or the chemical sensitizers S-1 and Au-1 were not added. To 25 g of the emulsion formulation was added 18.2 g of $YSrTaO_4$ (CP-1) and mixed for an additional 5 minutes. Photothermographic materials were imaged and developed as described in Example 1.

This solution was coated to a phosphor coating weight of 82 g/m$^2$. The sensitometric results shown below in TABLE III, demonstrates that CP-1 has slow speed, and increased contrast and Dmin when the phosphor is formulated with a non-chemically sensitized emulsion formulation.

TABLE III

| Example | S-1/Au-1 Present | Dmin | SP-2 | AC-1 |
|---|---|---|---|---|
| 2-1 | Yes | 0.83 | 4.35 | 2.66 |
| 2-2 | No | 0.90 | 2.94 | 3.04 |

The X-ray sensitometric response of these photothermographic materials with CP-1 phosphor was determined with these emulsion formulations shown below.

The density of these samples were measured with a X-rite 310 densitometer using the Status A filters and measured with the visible filter. The sensitometric results, shown below in TABLE IV, demonstrate low sensitivity to X-rays when phosphor CP-1 phosphor is formulated with a non-chemically sensitized emulsion.

TABLE IV

| Example | S-1/Au-1 Present | (Developed Density − Dmin) at 0.4 sec | (Developed Density − Dmin) at 0.8 sec |
|---|---|---|---|
| 2-1 | Yes | 1.25 | 2.08 |
| 2-2 | No | 0.00 | 0.04 |

EXAMPLE 3

Alternate Phosphors P-1 and P-2 Used in Photothermographic Materials

The preparation of a photothermographic formulation was carried out as follows:

A preformed silver bromoiodide (98% Br/2% I), silver carboxylate "soap" was prepared as described in U.S. Pat. No. 6,413,710 (Shor et al.). The average grain size was 0.15 μm. The photothermographic emulsions were chemically sensitized according to procedures described in U.S. Pat. No. 6,423,481 (Simpson et al.) using the materials and amounts shown below.

Photothermographic Emulsion Formulation

To 161.3 g of this silver soap dispersion at 28.73% solids was added in order:

| Compound | Amount | Mix Time | Temp. |
|---|---|---|---|
| MEK | 18.8 g | 15 minutes | 67° F. (19.4° C.) |
| Zinc Bromide | 0.0845 g in 0.60 g of MeOH | 15 minutes | |
| Compound S-1 | 8.1 ml of a solution of 0.0508 g in 8.64 g of MeOH | 60 minutes | |
| Zinc Bromide | 0.0845 g in 0.60 g of MeOH | 15 minutes | |
| PHP | 0.20 g in 1.58 g of MeOH | 60 minutes | |
| Cool | | 10 minutes | 61° F. (16.1° C.) |
| Compound Au-1 | 4.8 ml of a solution of 0.0052 g in 50 g of MeOH | 60 minutes | |
| Chlorobenzoyl benzoic acid | 1.42 g | 15 minutes | |
| Cool | | 20 minutes | 50 F. (10° C.) |
| BUTVAR ® B-79 | 20 g | 30 minutes | |
| Antifoggant AF-A | 1.94 g | 10 minutes | |
| DESMODUR ® N3300 | 0.63 g in 1.5 g of MEK | | |
| Phthalazine | 1.0 g in 5 g of MEK | 15 minutes | |
| Tetrachlorophthalic acid | 0.35 g in 2 g of MEK | | |
| 4-Methylphthalic acid | 0.45 g in 4 g of MEK | 15 minutes | |
| PERMANAX ® WSO | 10.6 g | 15 minutes | |
| Citric Acid | 3.8 ml of a solution of 0.105 g in 6.0 g MEK and 1.89 g of MeOH | 15 minutes | |

Protective Topcoat Formulation

A protective topcoat for the photothermographic emulsion layer was prepared as follows:

| | |
|---|---|
| ACRYLOID ® A-21 | 0.58 g |
| CAB 171-15S | 14.9 g |
| MEK | 183.4 g |
| VS-1 | 0.3 g |
| Benzotriazole | 1.6 g |
| Antifoggant AF-B | 0.12 g |

To 25.0 g aliquots of the photothermographic coating formulation was added 22.5 g of $YSrTaO_4$ (CP-1) phosphor (average particle size of 4.0 μm), 22.5 g $YSrTaO_4$ (CP-2) phosphor (average size of 7.5 μm), 22.5 g of $LaPO_4$:Ce (P-1) phosphor (average particle size of 4.7 μm) or 22.5 g of $YPO_4$:Ce (P-2) phosphor (average size of 10.0 μm). The materials were mixed for an additional 5 minutes to prepare the final photothermographic coating formulations. Photothermographic materials were imaged and developed as described in Example 1.

These solutions were coated to similar phosphor coating weights approximately from 101 to 105 g/m$^2$. The sensitometric results, shown below in TABLE V demonstrate that CP-2 and P-1 have similar speed and contrast when these compounds are formulated with a standard emulsion formulation. An increase in Dmin was observed with P-1. There was some loss in speed and contrast with P-2, but the Dmin was decreased compared to P-1. Both P-1 and P-2 had lower Dmin than CP-1.

TABLE V

| Example | Phosphor | Dmin | SP-2 | AC-2 |
|---|---|---|---|---|
| 3-1 | CP-1 | 1.28 | 4.08 | 4.10 |
| 3-2 | CP-2 | 1.00 | 4.10 | 4.10 |
| 3-3 | P-1 | 1.16 | 4.07 | 4.07 |
| 3-4 | P-2 | 1.11 | 3.95 | 3.43 |

The X-ray sensitometric response of these photothermographic materials was determined by exposing the samples using a Fischer X-ray unit operating at 200 mA and 76 KeV filtered with a 3.0 mm sheet of aluminum. The samples were placed on a table set at 85.5 cm from the X-ray source. A series of X-ray exposures of constant intensity and exposure times of from 0.05 to 1.5 seconds was made. After samples were exposed they were processed in a manner similar as described in Example 1.

The density of these samples were measured with an X-rite 310 densitometer using the Status A filters and measured with the visible filter. The sensitometric results, shown below in TABLE VI, demonstrate sensitivity to X-rays for the P-1 and P-2 phosphors.

TABLE VI

| Example | Phosphor | (Developed Density − Dmin) at 0.4 sec | (Developed Density − Dmin) at 0.8 sec |
|---|---|---|---|
| 3-1 | CP-1 | 2.30 | 3.90 |
| 3-2 | CP-2 | 1.97 | 3.32 |
| 3-3 | P-1 | 1.69 | 2.56 |
| 3-4 | P-2 | 1.02 | 2.18 |

EXAMPLE 4

Alternate Phosphors P-3, P-CP3, and P-5 Used in Photothermographic Materials Photothermographic materials were prepared as described in Example 3 except that 1.82 g of Antifoggant AF-A was used and no citric acid was added to the photothermographic emulsion formulation, and the photothermographic topcoat formulation used is described in Example 1. To 25 g of the photothermographic emulsions was added 20.2 g of $YSrTaO_4$ (CP-1) phosphor, $SrB_4O_7$:Eu,F (P-3) phosphor; $BaMgAl_{11}O_{19}$:Ce (CP-3) or $Sr_2P_2O_7$:Eu (P-5). The materials were mixed for an additional 5 minutes to prepare the final photothermographic coating formulations. Photothermographic materials were imaged and developed as described in Example 1.

These solutions were coated to similar phosphor coating weights approximately from 88 to 91 g/m$^2$. The sensitometric results, shown below in TABLE VII demonstrate that CP-1 and P-5 have similar speed, but lower contrast when these compounds are formulated with a standard emulsion formulation. An increase in Dmin was observed with P-5. There was some loss in speed and contrast with P-3, but the Dmin was decreased compared to P-1. Phosphor CP-3 showed similar speed, but higher Dmin and low contrast.

TABLE VII

| Example | Phosphor | Dmin | SP-2 | AC-2 |
|---|---|---|---|---|
| 4-1 | CP-1 | 1.13 | 4.27 | 4.35 |
| 4-2 | P-3 | 0.81 | 4.08 | 3.62 |
| 4-3 | CP-3 | 1.35 | 4.28 | 0.93 |
| 4-4 | P-5 | 1.20 | 4.22 | 3.16 |

The X-ray sensitometric response of these photothermographic materials was determined by exposing the samples using a Fischer X-ray unit operating at 200 mA and 76 KeV filtered with a 3.0 mm sheet of aluminum. The samples were placed on a table set at 85.5 cm from the X-ray source. A series of X-ray exposures of constant intensity and exposure times of from 0.05 sec to 1.5 sec was made. After samples were exposed they were processed in a manner similar as described in Example 1.

The density of these samples were measured with an X-rite 310 densitometer using the Status A filters and measured with the visible filter. The sensitometric results, shown below in TABLE VIII, demonstrate sensitivity to X-rays for the P-3, CP-3 and P-5 phosphors.

TABLE VIII

| Example | Phosphor | (Developed Density − Dmin) at 0.8 sec | (Developed Density − Dmin) at 1.5 sec |
|---|---|---|---|
| 4-1 | CP-1 | 3.67 | 4.19 |
| 4-2 | P-3 | 0.12 | 0.23 |
| 4-3 | CP-3 | 0.31 | 0.62 |
| 4-4 | P-5 | 0.57 | 1.08 |

EXAMPLE 5

Aqueous Coated Phosphor-Containing Photothermographic Materials Using Iridium-Doped Ultra-Thin Tabular Grain Silver Halide Emulsions An ultrathin tabular grain silver halide emulsion was prepared as described below and in copending and commonly assigned U.S. Ser. No. 10/826,708 (Olm et al).

A vessel equipped with a stirrer was charged with 6 liters of water containing 4.21 g of lime-processed bone gelatin, 4.63 g of sodium bromide, 75.6 mg of potassium iodide, a known antifoamant, and 1.25 ml of 0.1 molar sulfuric acid. It was then held at 39° C. for 5 minutes. Simultaneous additions were then made of 25.187 ml of 0.6 molar silver nitrate and 19.86 ml of 0.75 molar sodium bromide over 30 seconds. Following nucleation, 50 ml of a 0.58% solution of the oxidant Oxone was added. Next, a mixture of 0.749 g of sodium thiocyanate and 30.22 g of sodium chloride dissolved in 136.4 g of water was added and the temperature was increased to 54° C. over 9 minutes. After a 5-minute hold, 100 g of oxidized methionine lime-processed bone gelatin in 1.412 liters of water containing additional antifoamant at 54° C. were then added to the reactor. During the next 38 minutes, the first growth stage took place wherein solutions of 0.6 molar silver nitrate, 0.75 molar sodium bromide, and a 0.29 molar suspension of silver iodide (Lippmann) were added to maintain a nominal uniform iodide level of 4.2 mole %. The flow rates during this growth segment were linearly increased from 9 to 42 ml/min (silver nitrate), from 11.4 to 48.17 ml/min (sodium bromide) and from 0.8 to 3.7 ml/min (silver iodide). The flow rates of the sodium bromide were unbalanced from the silver nitrate in order to increase the pBr during the segment. During the next 64 minutes, the second growth stage took place wherein solutions of 3.5 molar silver nitrate and 4.5 molar sodium bromide and a 0.29 molar suspension of silver iodide (Lippmann) were added to maintain a nominal iodide level of 4.2 mole %. The flow rates during this segment were increased from 8.6 to 38 ml/min (silver nitrate) and from 5.2 to 22.0 ml/min (silver iodide). The flow rates of the sodium bromide were allowed to fluctuate as needed to maintain a constant pBr.

During the next 38 minutes, the third growth stage took place wherein solutions of 3.5 molar silver nitrate and 4.5 molar sodium bromide and a 0.29 molar suspension of silver iodide (Lippmann) were added to maintain a nominal iodide level of 4.2 mole %. The flow rates during this segment were 42 ml/min (silver nitrate), nominally-32 ml/min (sodium bromide)-pBr control, and 22 ml/min (silver iodide). The temperature was decreased from 54° C. to 35° C. during this segment. At a point approximately 13.5 minutes after the start of this segment, 1 ml of a 2.06 millimolar aqueous solution of $K_2[IrCl_5$(5-bromo-thiazole)] was added. This corresponds to a concentration of 0.164 ppm to silver halide.

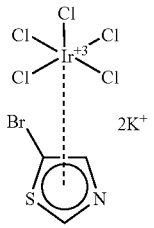

$K_2[IrCl_5$(5-bromo-thiazole)]

A total of 12.6 moles of silver iodobromide (4.2% bulk iodide) were formed. The resulting emulsion was washed via ultrafiltration. Lime-processed bone gelatin (269.3 g) was added along with a biocide and pH and pBr were adjusted to 6 and 2.5 respectively.

The resulting emulsion was examined by Scanning Electron Microscopy. Tabular grains accounted for greater than 99% of the total projected area. The mean ECD of the grains was 2.73 μm. The mean tabular thickness was 0.063 μm.

This emulsion was further sensitized using a sulfur sensitizer (compound SS-1 as described in U.S. Pat. No. 6,296,998 of Eikenberry et al.) at 60° C. for 10 minutes, and 2.0 mmol of blue sensitizing dye SSD-1 (shown above) per mole of silver halide was added before the chemical sensitizers.

Aqueous-based photothermographic materials were prepared by mixing the following compounds in order as follows:

| | |
|---|---|
| Silver benzotriazole (BZT) dispersion | 7.00 g (4.38 mmol) |
| Water | 0.40 g |
| Lime-processed gelatin | 0.86 g (35% in water) |
| 3-Methylbenzothiazolium iodine | 0.48 g (5% in water) |
| Sodium Benzotriazole | 0.29 g (0.7 M) |
| Mercaptotriazole Compound (T-1) | 0.02 g (in 0.92 g of water and 0.06 g of 2.5N NaOH) |
| Zonyl FSN | 0.22 g (5% in water) |
| Silver Halide Emulsion | 0.62 g (0.85 mmol) |

A solution of the following compounds was added to above formulation:

| | |
|---|---|
| Water | 2.17 g |
| Compound VS-2 | 0.02 g |

-continued

| | |
|---|---|
| Succinimide | 0.04 g |
| 1,3-Dimethylurea | 0.05 g |
| Ascorbic Acid | 0.55 g |

To this aqueous photothermographic formulation was added 12 g of phosphor particles CP-1, CP-2, or P-1, P-2, CP-3, P-3, or P-5, and mixed for 30 seconds. Control formulations were also prepared without phosphor particles.

The aqueous formulations were coated under safelight conditions onto a gelatin primed 178 μm blue-tinted poly (ethylene terephthalate) support using a knife coater. Samples were dried at 126° F. (52.2° C.) for 8.2 minutes. The silver coating weights of the samples were approximately 1.8 g/m$^2$. The phosphor-containing formulations were coated at approximate phosphor coating weights of 69 g/m$^2$ to 77 g/m$^2$. Samples of the photothermographic materials were imagewise exposed for $10^{-2}$ seconds using an EG&G Flash sensitometer equipped with both a P-16 filter and a 0.7 neutral density filter to provide continuous tone "wedges". Following exposure, the films were developed using a heated roll processor for 23 seconds at 150.0° C.

As shown in TABLE IX below, the sensitometric results demonstrates that materials incorporating phosphors P-2, CP-3, and P-5 have similar speed SP-2 when these compounds are compared to phosphor CP-2. Phosphors P-1 and P-3 have slower SP-2. An increase in Dmin was observed with phosphors P-3, CP-3, and P-5.

TABLE IX

| Example | Phosphor | Dmin | Dmax | SP-2 |
|---|---|---|---|---|
| 5-1 | CP-1 | 0.63 | 2.68 | 5.07 |
| 5-2 | CP-2 | 0.62 | 2.05 | 4.84 |
| 5-3 | P-1 | 0.60 | 2.78 | 4.54 |
| 5-4 | P-2 | 0.61 | 2.51 | 4.78 |
| 5-5 | P-3 | 0.68 | 2.26 | 4.56 |
| 5-6 | CP-3 | 0.74 | 2.18 | 4.82 |
| 5-7 | P-5 | 0.85 | 2.96 | 4.84 |

The X-ray sensitometric responses of these photothermographic materials, a photothermographic material that did not contain any phosphor, and a sample of KODAK ULTRASPEED® X-ray Film 4502 were determined by exposing the samples using a Fischer X-ray unit operating at 200 mA and 76 KeV filtered with a 3.0 mm sheet of aluminum. The samples were placed on a table set at 85.5 cm from the X-ray source. A series of X-ray exposures of constant intensity and exposure times of from 0.0083 to 1.5 seconds was made. After samples were exposed they were processed in a manner similar as described in Example 1 except for the KODAK ULTRASPEED® film, which was processed with a standard photographic processor.

The density of these samples were measured with an X-rite 310 densitometer using the Status A filters and measured with the visible filter. The sensitometric results, shown below in TABLE X, demonstrate sensitivity to X-rays for the P-1, P-2, P-3, CP-3, and P-5 phosphors. Similar or faster X-ray response as compared to the KODAK ULTRASPEED® material was observed with phosphors P-1, P-2, or P-5.

TABLE X

| Example | Phosphor | (Developed Density − Dmin) at 0.05 sec | (Developed Density − Dmin) at 0.1 sec | (Developed Density − Dmin) at 0.2 sec |
|---|---|---|---|---|
| 5-0 | None | 0.02 | 0.05 | 0.09 |
| 5-1 | CP-1 | 1.59 | 1.70 | 1.81 |
| 5-2 | CP-2 | 1.24 | 1.40 | 1.60 |
| 5-3 | P-1 | 0.35 | 0.71 | 1.13 |
| 5-4 | P-2 | 0.66 | 0.97 | 1.23 |
| 5-5 | P-3 | 0.00 | 0.30 | 0.61 |
| 5-6 | CP-3 | 0.00 | 0.20 | 0.64 |
| 5-7 | P-5 | 0.95 | 1.27 | 1.40 |
| 5-8 | ULTRASPEED ® | 0.44 | 0.96 | 1.73 |

EXAMPLE 6

Aqueous-Based Photothermographic Materials

Formulations were prepared in a similar manner as described in Example 5 except to 25 g aliquots of the emulsion formulation was added 15 g of the phosphor particles P-1, P-2, P-3, CP-3, or P-5, and mixed for 30 seconds. The phosphor-containing formulations were coated at approximate phosphor coating weights of 91 g/m$^2$ to 107 g/m$^2$. Samples of these photothermographic materials were exposed, imaged, and processed as described in Example 5.

The sensitometric results, shown below in TABLE XI, demonstrate that phosphors P-2, CP-3, and P-5 have similar speed (SP-2) and are faster than phosphors P-1 and P-3. Materials incorporating phosphors CP-3 and P-5 had a higher Dmin.

TABLE XI

| Example | Phosphor | Dmin | Dmax | SP-2 |
|---|---|---|---|---|
| 6-1 | P-1 | 0.64 | 3.32 | 4.72 |
| 6-2 | P-2 | 0.75 | 3.04 | 4.76 |
| 6-3 | P-3 | 0.75 | 2.78 | 4.65 |
| 6-4 | CP-3 | 0.93 | 2.68 | 4.79 |
| 6-5 | P-5 | 1.18 | 3.58 | 4.81 |

The X-ray sensitometric responses of these photothermographic materials and the comparative KODAK ULTRASPEED® photographic material were determined in a similar manner as described in Example 5. The sensitometric results, shown below in TABLE XII, demonstrate sensitivity to X-rays for phosphors P-1, P-2, P-3, CP-3, or P-5. Faster X-ray response as compared to the KODAK ULTRASPEED® material was observed with phosphors P-1, P-2, and P-5.

TABLE XII

| Example | Phosphor | (Developed Density − Dmin) at 0.05 sec | (Developed Density − Dmin) at 0.1 sec | (Developed Density − Dmin) at 0.2 sec |
|---|---|---|---|---|
| 6-0 | None | 0.02 | 0.05 | 0.09 |
| 6-1 | P-1 | 0.82 | 1.26 | 1.63 |
| 6-2 | P-2 | 1.12 | 1.52 | 1.70 |
| 6-3 | P-3 | 0.26 | 0.43 | 0.82 |
| 6-4 | CP-3 | 0.14 | 0.36 | 0.62 |
| 6-5 | P-5 | 1.03 | 1.33 | 1.58 |
| 6-6 | ULTRASPEED ® | 0.44 | 0.96 | 1.73 |

EXAMPLE 7

Aqueous-Based Photothermographic Materials

A tabular grain silver halide emulsion was prepared as described in Example E of U.S. Pat. No. 6,576,410 (Zou et al.), incorporated herein by reference. The following changes were made during the preparation:

The simultaneous addition of silver nitrate and silver bromide was carried out over 30 seconds.

No potassium tetrachloroiridate was added.

The resulting emulsion was examined by Scanning Electron Microscopy. Tabular grains accounted for greater than 99% of the total projected area. The mean ECD of the grains was 2.642 μm.

The emulsion was sensitized with 1.0 mmol of blue sensitizing dye SSD-1 per mole of silver halides. Chemical sensitization was carried out for 10 minutes at 60° C. using 0.0056 mmol of sulfur sensitizer (compound SS-1a) per mole of silver halide and 0.0053 mmol of potassium tetrachloroaurate per mole of silver halide.

Inventive aqueous photothermographic materials were prepared by mixing the following compounds in order as follows:

| | |
|---|---|
| Silver benzotriazole (BZT) dispersion | 7.00 g (4.38 mmol) |
| Water | 0.40 g |
| Lime-processed gelatin | 0.86 g (35% in water) |
| 3-Methylbezothiazolium iodine | 0.48 g (5% in water) |
| Sodium Benzotriazole | 0.29 g (0.7 M) |
| Mercaptotriazole Compound (T-1) | 0.02 g (in 0.92 g of water and 0.06 g of 2.5N NaOH) |
| Zonyl FSN | 0.22 g (5% in water) |
| Silver Halide Emulsion | 0.60 g (0.87 mmol) |

A solution of the following compounds was added to above formulation:

| | |
|---|---|
| Water | 2.17 g |
| Bisvinyl sulfonyl methane (VS-2) | 0.02 g |
| Succinimide | 0.04 g |
| 1,3-Dimethylurea | 0.05 g |
| Ascorbic Acid | 0.55 g |

To this aqueous photothermographic formulation was added 12 g of phosphor particles CP-1, or phosphors P-1, P-2, P-3, CP-3, or P-5, and mixed for 30 seconds. Control formulations were prepared without phosphor particles. The phosphor-containing formulations were coated at approximate phosphor coating weights of 68 g/m$^2$ to 77 g/m$^2$. Samples of these photothermographic materials were exposed and imaged as described above, but processed for 25 seconds at 150.0° C.

As shown in TABLE XIII below, the sensitometric results demonstrate that all P-1, P-2, P-3, CP-3, and P-5 have slower speed (SP-2) when these compounds are compared to CP-1. An increase in Dmin was observed with phosphors CP-3 and P-5.

TABLE XIII

| Example | Phosphor | Dmin | Dmax | SP-2 |
|---|---|---|---|---|
| 7-1 | CP-1 | 0.85 | 2.82 | 5.00 |
| 7-2 | P-1 | 0.74 | 2.94 | 4.45 |
| 7-3 | P-2 | 0.81 | 2.79 | 4.48 |
| 7-4 | P-3 | 0.76 | 2.18 | 4.08 |
| 7-5 | CP-3 | 1.90 | 2.49 | — |
| 7-6 | P-5 | 1.55 | 2.94 | 3.96 |

The X-ray sensitometric responses of these photothermographic materials, a photothermographic material that does not contain any phosphor, and a KODAK ULTPASPEED® conventional photographic film were determined by exposing the samples using a Fischer X-ray unit operating at 200 mA and 76 KeV filtered with a 3.0 mm sheet of aluminum. The samples were placed on a table set at 85.5 cm from the X-ray source. A series of X-ray exposures of constant intensity and exposure times of from 0.0083 to 1.5 seconds was made. After samples were exposed they were processed in a manner similar as described in Example 1 except for the KODAK ULTRASPEED® material, which was processed with a standard photographic processor.

The density of these samples were measured with an X-rite 310 densitometer using the Status A filters and measured with the visible filter. The sensitometric results, shown below in TABLE XIV, demonstrate sensitivity to X-rays for phosphors P-1, P-2, P-3, CP-3, and P-5. The fastest X-ray response was observed with phosphors P-1, P-2, or P-5.

TABLE XIV

| Example | Phosphor | (Developed Density − Dmin) at 0.05 sec | (Developed Density − Dmin) at 0.1 sec | (Developed Density − Dmin) at 0.2 sec |
|---|---|---|---|---|
| 7-0 | None | 0.03 | 0.05 | 0.11 |
| 7-1 | CP-1 | 1.89 | 2.17 | 2.25 |
| 7-2 | P-1 | 0.19 | 0.65 | 1.03 |
| 7-3 | P-2 | 0.50 | 0.58 | 0.97 |
| 7-4 | P-3 | 0.00 | 0.30 | 0.40 |
| 7-5 | CP-3 | 0.23 | 0.36 | 0.40 |
| 7-6 | P-5 | 0.47 | 0.74 | 0.97 |
| 7-7 | ULTRASPEED ® | 0.44 | 0.96 | 1.73 |

EXAMPLE 8

Aqueous-Based Photothermographic Materials

Formulations were prepared in a similar manner as described in Example 7 except to 25 g aliquots of the emulsion formulation was added 15 g of the phosphor particles P-1, P-2, P-3, CP-3, or P-5, and mixed for 30 seconds. The phosphor-containing formulations were coated at approximate phosphor coating weights of from 101 g/m$^2$ to 108 g/m$^2$. Samples of these photothermographic materials were exposed, imaged, and processed as described in Example 7.

The sensitometric results, shown below in TABLE XV, demonstrate that phosphors P-2, and P-3 have similar speed (SP-2) and are faster than phosphors CP-3 and P-5. An increase in Dmin was observed with phosphors CP-3 and P-5.

TABLE XV

| Example | Phosphor | Dmin | Dmax | SP-2 |
|---|---|---|---|---|
| 8-1 | P-1 | 0.93 | 3.47 | 4.47 |
| 8-2 | P-2 | 1.16 | 3.15 | 4.40 |
| 8-3 | P-3 | 0.88 | 2.87 | 4.38 |
| 8-4 | CP-3 | 2.87 | 3.27 | |
| 8-5 | P-5 | 1.74 | 3.64 | 4.28 |

The X-ray sensitometric responses of these photothermographic materials and the comparative KODAK ULTRASPEED® photographic material were determined in a similar manner as described in Example 5. The sensitometric results, shown below in TABLE XVI, demonstrate sensitivity to X-rays for phosphors P-1, P-2, P-3, CP-3, and P-5. Faster or similar X-ray response as compared to the KODAK ULTRASPEED® material was observed with phosphors P-1, P-2, and P-5.

TABLE XVI

| Example | Phosphor | (Developed Density – Dmin) at 0.05 sec | (Developed Density – Dmin) at 0.1 sec | (Developed Density – Dmin) at 0.2 sec |
|---|---|---|---|---|
| 8-0 | None | 0.03 | 0.05 | 0.11 |
| 8-1 | P-1 | 0.49 | 0.94 | 1.38 |
| 8-2 | P-2 | 0.79 | 1.20 | 1.47 |
| 8-3 | P-3 | 0.21 | 0.44 | 0.71 |
| 8-4 | CP-3 | 0.27 | 0.27 | 0.33 |
| 8-5 | P-5 | 0.70 | 1.14 | 1.29 |
| 8-6 | ULTRASPEED ® | 0.44 | 0.96 | 1.73 |

The invention has been described in detail with particular reference to certain preferred embodiments thereof, but it will be understood that variations and modifications can be effected within the spirit and scope of the invention.

The invention claimed is:

1. A photothermographic material comprising a support having thereon, one or more imaging layers comprising:

a. a photosensitive silver halide, b. in reactive association with said photosensitive silver halide, a non-photosensitive source of reducible silver ions, c. a reducing agent for said reducible silver ions, and d. one or more X-radiation-sensitive phosphors each of which emits in the range of from about 100 to about 410 nm, said X-radiation-sensitive phosphor comprising a rare earth phosphate, a yttrium phosphate, a strontium phosphate, or a strontium fluoroborate.

2. The material of claim 1 comprising a cerium activated rare earth phosphate, a yttrium phosphate, or a europium activated strontium fluoroborate as said X-radiation-sensitive phosphor.

3. The material of claim 1 wherein said X-radiation-sensitive phosphor is a rare earth phosphate or yttrium phosphate that has a zircon or monazite crystal structure.

4. The material of claim 2 comprising a europium activated strontium fluoroborate having a composition defined from the following Structure (I) as said X-radiation-sensitive phosphor:

$$M_aF_bB_cO_d{:}eEu \quad (I)$$

wherein M is strontium, or a mixture of metals containing strontium and one or more of the metals Mg or Ca, F is fluoride, B is boron, O is oxygen $0<a\leqq1.5$, $0<b\leqq0.5$, $2<c\leqq5$, $3<d\leqq7$, $0<e\leqq0.25$ and $0<a+e\leqq2$.

5. The material of claim 1 comprising a strontium phosphate having a composition defined by the following Structure (II) as said X-radiation-sensitive phosphor:

$$M^1_{a1}M^2_{b1}M^3_{c1}P_{d1}O_{e1} \quad (II)$$

wherein $M^1$ and $M^2$ are different metals selected from the group consisting of Mg, Ca, Sr, and Zn, $M^3$ is one or more of the metals Eu, Mn, Sn, and Pb, $0<a1\leqq1$, $0<b1\leqq1$, $0<c1\leqq0.2$, $0<a1+b1+c1\leqq2$, $0<d1\leqq4$, and $0<e1\leqq10$.

6. The material of claim 1 comprising a cerium and strontium activated rare earth phosphate or yttrium phosphate as said X-radiation-sensitive phosphor.

7. The material of claim 6 comprising a cerium and strontium activated or co-activated rare earth phosphate or a cerium and strontium activated yttrium phosphate having a composition defined by the following Structure (III) as said X-radiation-sensitive phosphor:

$$M^1_{a2}M^2_{b2}M^3_{c2}M^4_{d2}P_{e2}O_f \quad (III)$$

wherein $M^1$ is lanthanum or yttrium, $M^2$ is cerium, $M^3$ is gadolinium, ytterbium, or a mixture thereof, $M^4$ is strontium or a strontium-containing mixture of alkaline earth metals, $0<a2\leqq1$, $0<b2\leqq0.6$, $0<c2\leqq0.5$, $0<d2\leqq0.1$, $0<a2+b2+c2+d2\leqq(e2+1)$, and $0<f\leqq(4.5e2)$.

8. The material of claim 7 wherein said X-radiation-sensitive phosphor has a monazite crystal structure and a composition that is defined by the following Structure (IV):

$$M^1_{a2}M^2_{b2}M^4_{d2}P_{e2}O_f \quad (IV)$$

wherein $M^1$ is lanthanum, $M^2$ is cerium, $M^4$ is strontium or a strontium-containing mixture of alkaline earth metals, $0.5<a2\leqq1$, $0.005<b2\leqq0.3$, $0<d2\leqq0.1$, $0<a2+b2+d2\leqq(e2+1)$, and $(3.5e2)<f\leqq(4.5e2)$.

9. The material of claim 1 comprising $LaPO_4$:Ce (P-1), $YPO_4$:Ce (P-2), $SrB_4O_7$:Eu,F (P-3), and $Sr_2P_2O_7$:Eu (P-5), or a mixture of two or more these compounds, as said X-radiation-sensitive phosphor(s).

10. The material of claim 1 wherein said X-radiation-sensitive phosphor is present in an amount of from about 1 to about 20 mole per mole of total silver and the total silver present in said material is at least 0.002 mol/$m^2$.

11. The material of claim 1 wherein said photosensitive silver halide and said X-radiation-sensitive phosphor are in the same imaging layer.

12. The material of claim 1 comprising the same or a different imaging layer(s) on both sides of said support.

13. The material of claim 1 wherein said binder is a hydrophobic binder.

14. The material of claim 1 wherein said binder is a hydrophilic binder or a hydrophobic polymer applied as a water-dispersible polymeric latex.

15. The material of claim 1 wherein said photosensitive silver halide is tabular silver halide containing an iridium dopant.

16. The material of claim 1 wherein said non-photosensitive source of reducible silver ions is:

a) a silver salt of a fatty acid having from 10 to 30 carbon atoms, or a mixture of said silver salts, at least one of which is silver behenate, b) a silver salt of a compound containing an imino group, or a mixture of said silver salts, at least one of which is silver benzotriazole, or c) a mixture of a) and b).

17. The material of claim 1 wherein said one or more imaging layers further comprise a spectral sensitizing dye, an acutance dye, a toner, a co-developer, or a contrast-enhancing agent.

18. The material of claim 1 wherein said photosensitive silver halide has been chemically sensitized with a sulfur-containing chemical sensitizing compound, a selenium-containing chemical sensitizing compound, a tellurium-containing chemical sensitizing compound, or a gold(III)- containing chemical sensitizing compound, or mixtures of any of these chemical sensitizing agents.

19. The material of claim 1 wherein said imaging layer comprising said X-radiation-sensitive phosphor has a dry coating weight of at least 5 $g/m^2$.

20. An X-radiation sensitive photothermographic material comprising a support having on one side thereof, a photothermographic imaging layer having a dry coating weight of from about 300 to about 400 $g/m^2$, said imaging layer comprising a binder and in reactive association:

a. a photosensitive silver bromide or silver bromoiodide, or mixture thereof, that has been chemically sensitized with a sulfur-containing chemical sensitizing compound, a selenium-containing chemical sensitizing compound, a tellurium-containing chemical sensitizing compound, or a gold(III)-containing chemical sensitizing compound, or mixtures of any of these chemical sensitizing agents, b. in reactive association with said photosensitive silver halide, a non-photosensitive source of reducible silver ions comprising silver behenate, silver benzotriazole, or a mixture thereof, c. a reducing agent for said reducible silver ions that comprises a hindered phenol or an ascorbic acid reducing agent, and d. one or more X-radiation-sensitive phosphors, each of which emits in the range of from about 100 to about 410 nm, said one or more X-radiation-sensitive phosphors being present in a total amount of from about 0.5 to about 20 mole per mole of total silver, the amount of total silver being from about 1 to about 5 $g/m^2$, and said X-radiation-sensitive phosphor having a monazite crystal structure and a composition that is defined by the following Structure (IV):

$$M^1_{a2}M^2_{b2}M^4_{d2}P_{e2}O_f \quad \text{(IV)}$$

wherein $M^1$ is lanthanum, $M^2$ is cerium, $M^4$ is strontium or a strontium-containing mixture of alkaline earth metals, $0.5<a2\leqq 1$, $0.005<b2\leqq 0.3$, $0<d2\leqq 0.1$, $0<a2+b2+d2\leqq(e2+1)$, and $(3.5e2)<f\leqq(4.5e2)$.

21. The material of claim 20 further comprising the same or a different photothermographic imaging layer on the backside of said support.

22. A method for forming a visible image comprising:

(A) imagewise exposing the photothermographic material of claim 1 to X-radiation to form a latent image, and (B) simultaneously or sequentially, heating said exposed photothermographic material to develop said latent image into a visible image.

23. The method of claim 22 for providing a radiographic image of a human or animal subject.

24. The method of claim 22 comprising using said visible image for a dental diagnosis.

25. A method for forming a visible image comprising:

(A) imagewise exposing the photothermographic material of claim 20 to X-radiation to form a latent image, and (B) simultaneously or sequentially, heating said exposed photothermographic material to develop said latent image into a visible image.

* * * * *